US010058185B2

(12) United States Patent
Naik et al.

(10) Patent No.: US 10,058,185 B2
(45) Date of Patent: Aug. 28, 2018

(54) THERMOPLASTIC CHAIR FLEXOR

(71) Applicant: EXEMPLIS LLC, Cypress, CA (US)

(72) Inventors: Tushar Naik, Irvine, CA (US); Ryan Dibble, Irvine, CA (US); Myong Kim, Irvine, CA (US); Brittney Blaise, Lakewood, CA (US); Ken-Soh Mai, Torrance, CA (US); Mitchell Mulder, Huntington Beach, CA (US)

(73) Assignee: EXEMPLIS LLC, Cypress, CA (US)

( * ) Notice: Subject to any disclaimer, the term of this patent is extended or adjusted under 35 U.S.C. 154(b) by 45 days.

(21) Appl. No.: 15/227,553

(22) Filed: Aug. 3, 2016

(65) Prior Publication Data

US 2017/0258232 A1 Sep. 14, 2017

Related U.S. Application Data

(60) Provisional application No. 62/305,984, filed on Mar. 9, 2016.

(51) Int. Cl.

| | |
|---|---|
| ***A47C 7/44*** | (2006.01) |
| ***A47C 7/00*** | (2006.01) |
| ***A47C 7/54*** | (2006.01) |

(52) U.S. Cl.

CPC ..... *A47C 7/44* (2013.01); *A47C 7/004* (2013.01); *A47C 7/006* (2013.01); *A47C 7/54* (2013.01)

(58) Field of Classification Search

CPC ..... A47C 7/44; A47C 7/004; A47C 7/006; A47C 7/54

See application file for complete search history.

(56) References Cited

U.S. PATENT DOCUMENTS

| | | | | |
|---|---|---|---|---|
| 4,379,589 A * | 4/1983 | Marino | A47C 7/448 | 248/621 |
| 5,411,316 A * | 5/1995 | Lovegrove | A47C 5/12 | 297/452.15 |
| 5,649,739 A * | 7/1997 | Zapf | A47C 7/405 | 297/284.4 |
| 6,739,663 B2 * | 5/2004 | Gevaert | A47C 7/445 | 297/296 |

(Continued)

*Primary Examiner* — Philip F Gabler
(74) *Attorney, Agent, or Firm* — David R. Heckadon; Sean D. Flaherty; Gordon Rees Scully Mansukhani LLP

(57) ABSTRACT

A seating structure employing a thermoplastic flexor defining the flexibility and stiffness of a seatback is provided. The seating structure may comprise a seat portion for supporting a user, a seatback portion for supporting a user, a frame for supporting the seat portion and the seatback portion, one or more base portions extending at an angle from the seatback portion, and one or more thermoplastic flexors affixed to or within the seatback and base portions of the seating structure. The thermoplastic flexor has certain material characteristics which define and limit the deflection and a rebound of the seatback portion relative to the base portion when under load. The seating structure may further comprise one or more anchors securing the seatback portion, base portion, and thermoplastic flexor to the frame. The seat portion, seatback portion, and base portion may comprise a unibody or multipiece chair shell, and the thermoplastic flexor may be completely enveloped within the shell, or partially disposed behind the shell in a nested mechanical relationship.

17 Claims, 19 Drawing Sheets

(56) References Cited

U.S. PATENT DOCUMENTS

| | | | | |
|---|---|---|---|---|
| 8,567,864 | B2 * | 10/2013 | Deisig | A47C 3/045<br>297/285 |
| 8,876,209 | B2 * | 11/2014 | Peterson | A47C 3/12<br>297/284.1 |
| 2009/0261644 | A1 * | 10/2009 | Piretti | A47C 7/282<br>297/344.12 |

* cited by examiner

THERMOPLASTIC CHAIR FLEXOR

RELATED APPLICATION

The present application claims priority to U.S. Provisional patent application 62/305,984, entitled "Thermoplastic Chair Flexor," filed Mar. 9, 2016, incorporated herein by reference in its entirety for all purposes.

FIELD

The present disclosure relates generally to structures for permitting and limiting movement of a seatback in predetermined manner.

BACKGROUND

Chairs and seatback hinges are generally known. Typically, a chair comprises a seat and a seatback interconnected by some structure. The structure connecting the seat and the seatback can be rigid, such as a metal elbow and flange, or it can provide some flexibility, like a spring.

Chair users tend to enjoy the ability to recline, as it provides enhanced comfort. However, chair users also enjoy having support for sitting in an upright fashion. Traditionally, providing both advantages; stiffness and flexibility, required the use of one or more metal springs, such as coil springs.

Using metal components in chairs, such as for a spring connecting a seat to a seatback, poses substantial cost and complexity to the production and sale of a chair. A user may be required to assemble the chair and properly install the spring. If the spring is not properly installed, then the chair will not provide the desired flexibility and stiffness. Additionally, metal springs rust and can make noise while in operation.

In contrast, using plastic components in chairs has the advantage of reduced cost. However, plastics are often not suitable for structural members, because plastics tend to deflect and deform when placed under stress, and traditionally have poor rebound characteristics. Flexible plastic chairs are often irreparably bent, which fails to deliver the desired support. Also by the same token, stiff plastic chairs are often so hard that a great deal of force is required to induce any deflection, with is uncomfortable and unpleasant for the user.

Accordingly, a need exists for a plastic chair flexor that provides both the flexibility and stiffness desired by a user.

SUMMARY

The following simplified summary provides a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

For example, the following embodiments disclose a seating structure comprising a seat portion for supporting a user, a seatback portion for supporting a user, a frame for supporting the seat portion and the seatback portion, a base portion extending at an angle from the seatback portion an thermoplastic flexor affixed to the seatback and base portions of the seating structure, and wherein the thermoplastic flexor defines and limits the deflection and the rebound of the seatback portion relative to the base portion, and an anchor securing the seatback portion, base portion, and thermoplastic flexor to the frame.

Moreover, some embodiments disclose a seating structure having one or more thermoplastic flexors comprised of a material, with an ultimate tensile strength characteristic, ranging from 5-117 MPa, an elastic modulus characteristic, E; ranging from 587-20700 MPa; a creep modulus, C, ranging from 1800-2500 MPa when a stress is applied for one hour, and a yield strain, Ys, of greater than 5%.

Some embodiments identify that the thermoplastic flexor may be a curvilinear elbow comprising an upper extension, a lower extension, and a waist connecting the upper and lower extensions. The thermoplastic flexor may further comprise dimples, apertures, teeth, or other mechanical interlocks throughout the body of the flexor. Differential mechanical interlocking features may optionally be located throughout the upper extension and the waist, as compared to the lower extension. The mechanical interlocking features serve to mechanically secure the thermoplastic flexor internally to the seatback and base portions.

Some embodiments further disclose a thermoplastic flexor further comprising a gap located transversely across the lower extension, a bridge connecting the two sides of the lower extension separated by the gap, a channel running axially from the bridge to the end of the lower extension, and at least one upright flange running axially from the gap to the end of the lower extension. In such embodiments, the gap creates a plurality of discontinuous cross sectional areas for resisting deflection through lower extension. The gap, bridge, channel, and one or more upright flanges further serve as mechanical interlocking features. Further, in some embodiments, the plurality of discontinuous cross sectional areas in the lower extension comprise (i) an area defined by the channel, (ii) an area defined by the bridge, and (iii) an area defined by the waist. Optionally in some embodiments, the shape of the channel changes throughout the length of the lower extension, and thus creates a differential cross sectional area throughout. For example, the cross sectional area defined by the channel and upright flanges may be greater on one side of the gap and bridge as compared to the cross sectional area formed by the channel and the upright flanges on the other side of the gap and bridge. In one embodiment, the channel terminates at a wall beyond the gap on the far side of the end of the lower extension. The termination of the channel at the wall defines the end of the cross sectional area of the channel, and the beginning of a much greater cross-sectional area of the waist.

In some embodiments, the thermoplastic flexor may further comprise a first fulcrum formed at a first interface of the lower extension and the anchor, and a second fulcrum formed at a second interface of the lower extension and the anchor. In one embodiment, the second fulcrum is located beneath the channel formed on the far side of the bridge relative to the end of the lower extension. In one embodiment, the first fulcrum may be beneath the bridge, and the second fulcrum may be beneath a transition region between the lower extension and the waist.

The embodiments disclose how the thermoplastic flexor exerts resistance forces sequentially through the plurality of discontinuous cross sectional areas, when the seatback is under a force. Specifically, the resistance forces are exerted first through the area defined by the channel, and next through the area defined by the bridge, and finally through the area defined by the waist. When the discontinuous cross sectional areas are resisting a force, it triggers the first fulcrum to engage before the second fulcrum engages, and when both fulcrums are engaged, a bending moment is concentrated through the bridge. In one embodiment, the second fulcrum engages before the first fulcrum. The sequential order in which the plurality of fulcrums engage can be defined by variations made to their positioning within the waist, lower extension, and transition region therebetween, as well as variation to the depth and/or angle of the gap, and also through variation to the cross sectional properties of the channel and upright flanges.

As a result of the discontinuous and sequential resistance imparted by the thermoplastic flexor, the seatback portion deflects according to a variable response characteristic when under load. Typically, the deflection of a seatback is determined by measuring the back deflection at the point of load wherein a load is applied according to an industry standard Sections 5 & 6 of ANSI/BIFMA X5.1-2011. Specifically, this load is applied horizontally to the seatback portion sixteen inches above the seat in the center of the seatback.

According to an embodiment, the thermoplastic flexor of the present disclosure results in a variable deflection response characteristic of the seatback when placed under load. When plotted on a graph, the variable deflection characteristic comprises a curve approaching a multi-linear response, meaning that deflection increases steadily for a predetermined distance according to a function as force is increased on the seatback, and thereafter deflection increases according to a second function as force is continued to be exerted on the seatback. For example, when a user exerts force on the seatback, the thermoplastic flexor may permit flexibility to allow the seatback to deflect more easily for a predetermined distance, and thereafter, the thermoplastic flexor will decrease flexibility and increase stiffness, permitting the seatback to deflect less easily. Inversely, the seatback may rebound according to a variable response characteristic when load is released. In this respect, the seatback may quickly and/or aggressively rebound initially through a predetermined distance when load is released from a significantly deflected state. This aggressive and/or fast rebounding is associated with enhanced stiffness preferred by a user for supporting upright sitting. Thereafter, the seatback may not rebound as aggressively as load continues to be released from a less deflected state. This non-aggressive and/or slower rebounding is associated with enhanced flexibility as desired by users through moderate ranges of deflection. When plotted on a graph, the variable rebound response characteristic of the seatback may comprise a curve approaching a multi-linear stiffness response when measured relative to the base portion.

In one embodiment, the seatback portion, base portion, and seat portion of the seating structure of the present disclosure may comprise a unibody thermoplastic shell. The unibody shell may be mounted directly to the chair frame, meaning that the seat, seatback, base, and base portions all connect to the frame together. In one embodiment, the unibody shell may connect to the frame at least through the anchor.

In one embodiment, optionally, the seatback portion and base portion comprise a multipiece shell. In this example, the seatback portion and base portions are an integrated structure, whereas the seat portion is a separate structure. In this configuration, the structure comprising the seatback portion and base portion is connected to the frame independently from the seat portion. In one embodiment, the structure comprising the seatback portion and base portion is connected to the frame independently from the seat portion at least through the anchor.

According to one embodiment, the thermoplastic flexor of the seating structure disclosed comprises polyoxymethylene (POM). This material, for example, is offered under the trademark, CELCON® M90, by Ticona Engineering Polymers.

According to various embodiments, the thermoplastic flexor may be injection molded. The thermoplastic flexor may be secured to the seatback and base portions through mechanical means, such as a screw and nut assembly, clips, pins, glue, or the like. Alternatively, the seatback and base portions may be overmolded relative to the thermoplastic flexor to surround and envelop the thermoplastic flexor.

According to an embodiment, the thermoplastic flexor may further comprise a stringer to increase the stiffness and/or enhance the rebound characteristics of the seatback. For example, the stringer may be molded within the thermoplastic flexor.

According to an embodiment, the thermoplastic flexor may not be totally encased within the base portion and seatback. Instead, in this configuration, the thermoplastic flexor remains at least partially disposed within the base portion. In this respect, the thermoplastic flexor is mechanically secured to the back of the seatback and underside of the base portions through mechanical attachment means. By not encasing or overmolding the thermoplastic flexor, less material may be used, and less cost incurred. Rather than requiring the thermoplastic flexor to be manufactured (molded) into the structure of the shell, or requiring the shell to be molded to the flexor, the flexor may be separately sourced and manufactured, and thereafter applied to the chair shell to obtain the desired performance characteristics.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

The features of the present disclosure may be economically molded by using one or more distinct parts and associated components which, when assembled together, may form the disclosed device regardless of the particular form. Unless defined otherwise, all terms of art, notations and other scientific terms or terminology used herein have the same meaning as is commonly understood by one of ordinary skill in the art to which this invention belongs.

In some cases, terms with commonly understood meanings are defined herein for clarity and/or for ready reference, and the inclusion of such definitions herein should not necessarily be construed to represent a substantial difference over what is generally understood in the art.

As used herein, "a" or "an" means "at least one" or "one or more."

The seating structure employing a thermoplastic flexor can now be better understood turning to the following detailed description. It is to be expressly understood that the illustrated embodiments are set forth as examples and not by way of limitations on the embodiments as ultimately defined in the claims.

Figure 1:
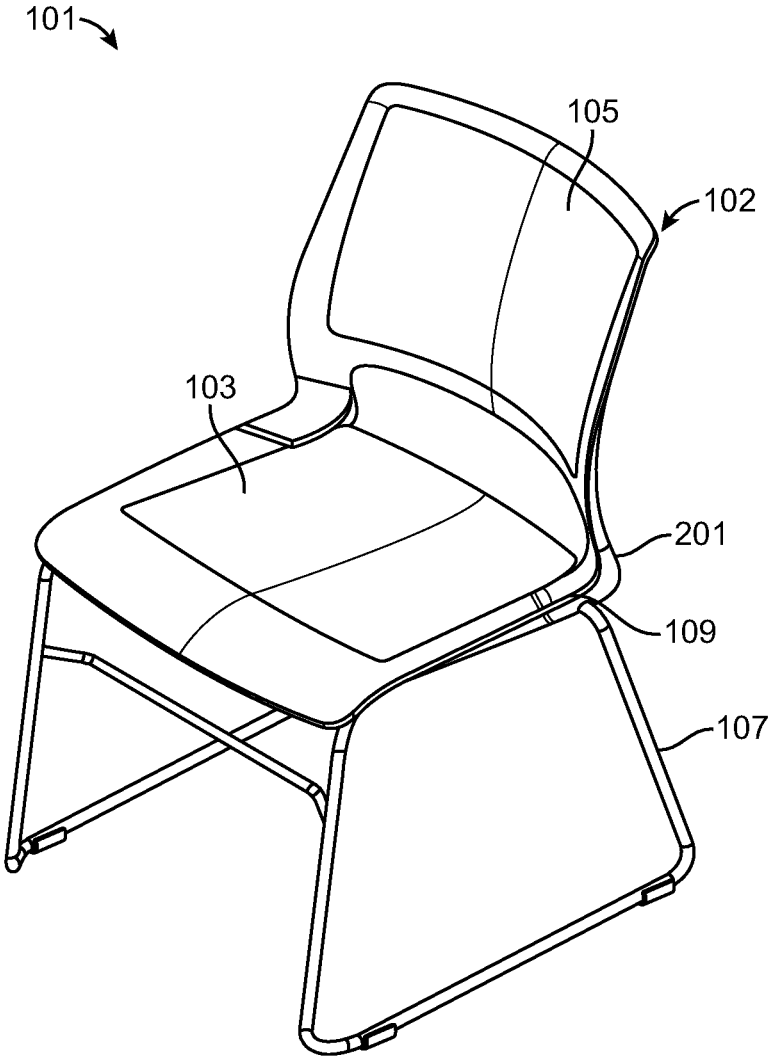
FIG. 1 is an isometric view of a seating structure, disclosing a seat, seatback, two base portions, one on each side of the seat, and a wire-type frame. The thermoplastic flexor of the present invention is not in view because in this embodiment, the chair shell is overmolded.

Turning to FIG. 1, is an isometric view of a seating structure 101, disclosing a seat 103, seatback 105, two base portions 109, one on each side of the seat 103, and a wire-type frame 107. The thermoplastic flexor 201 of the present invention is not in view because in this embodiment, a chair shell 102 is overmolded around the flexor 201. In this embodiment, the chair shell 102 is a two-piece shell. One piece 121 comprises the seatback 105 and base 109, while the second piece comprises the seat 103. This embodiment also illustrates the potential configuration wherein the thermoplastic flexor 201 is injection molded into the base 109 of one piece of the chair shell 102.

Figure 2:
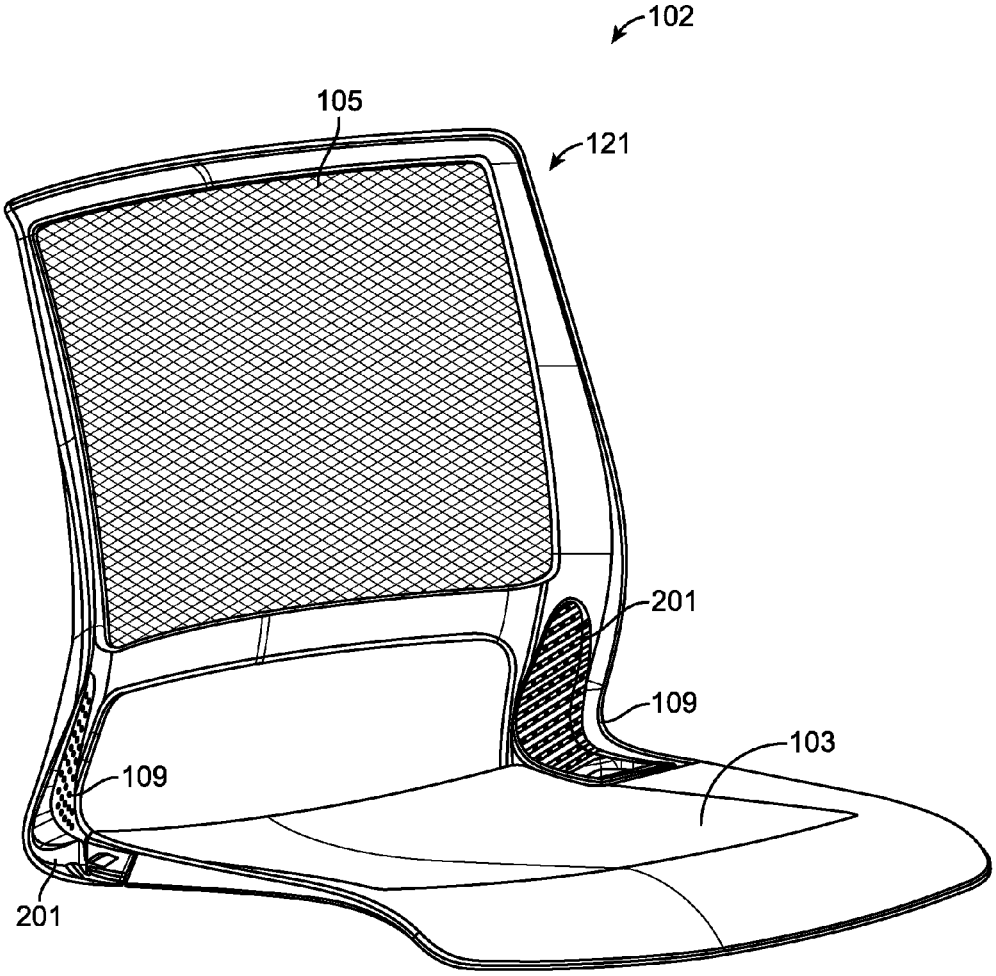
FIG. 2 is an exemplary isometric view of a chair shell disconnected from a frame. The seat, seatback, two base portions, and a thermoplastic flexor in each of the base portions are visible in ghost.

Turning to FIG. 2 is an exemplary isometric view of a two-piece chair shell 102 disconnected from a frame 107 (not seen). The seat 103, seatback 105, two base portions 109, and a thermoplastic flexor 201 in each of the base portions are visible in ghost. As noted in FIG. 1, the seatback 105, two base portions 109 form the upper piece 121 of the two piece shell 102, and the flexor 201 is located within the base 109 of the upper piece 121.

Figure 3:
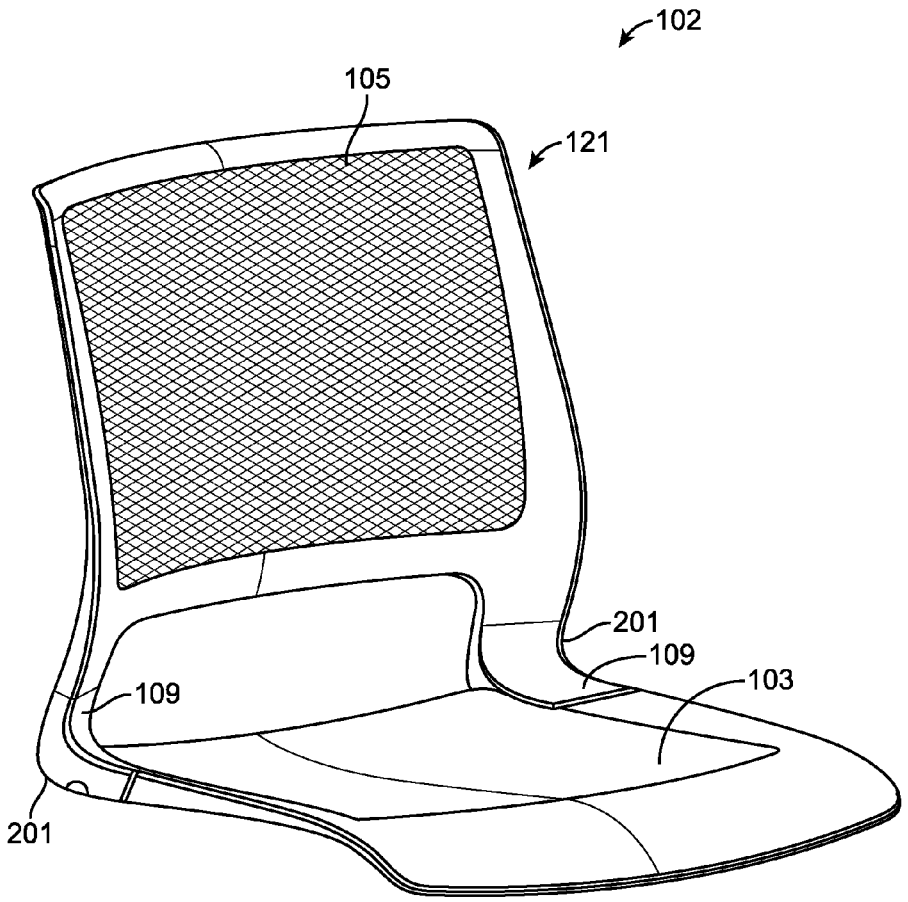
FIG. 3 discloses the chair shell of FIG. 2, but the thermoplastic flexors in each of the base portions are not visible.

Turning to FIG. 3 discloses the chair shell 102 of FIG. 2, but the thermoplastic flexors 201 in each of the base portions 109 of the upper shell 121 are not visible. This embodiment additionally depicts the configuration where the thermoplastic flexor 201 is optionally injection molded into the base 109 or in which the upper shell 121 is overmolded around the flexor 201.

Figure 4:
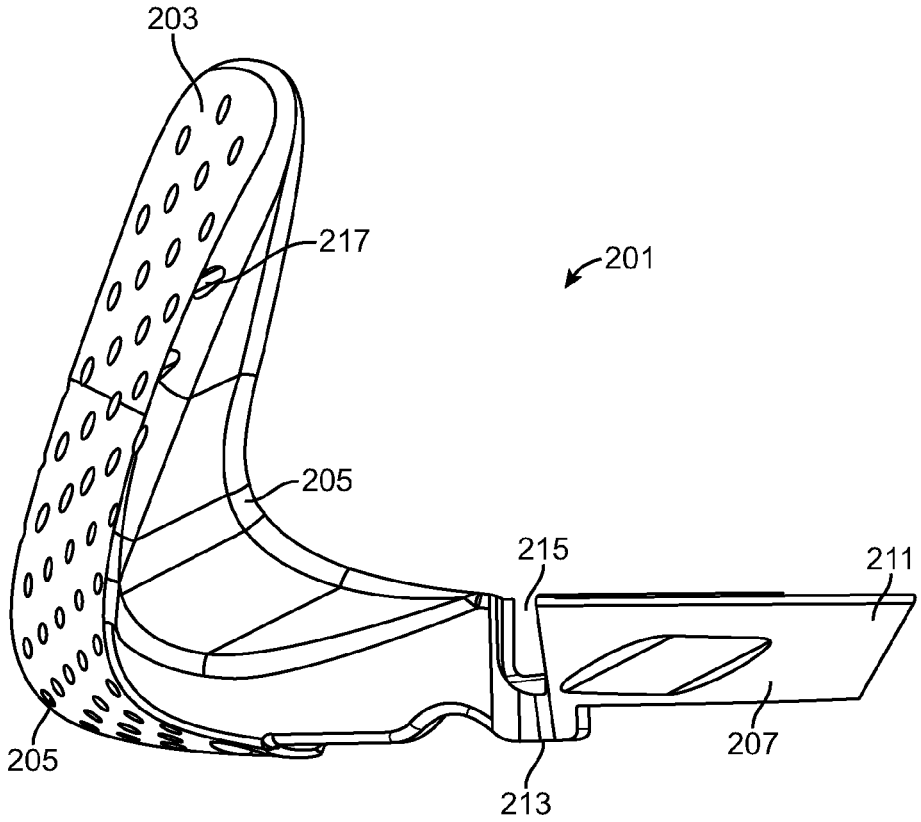
FIG. 4 is an exemplary profile view of the thermoplastic flexor of the present disclosure isolated outside the chair shell. The upper extension, waist, and lower extension are visible. A transverse gap and bridge are visible between the waist and the end extension. The upright flange of the axial channel is visible extending from the gap to the end of the lower extension.

Turning to FIG. 4 is an exemplary profile view of the thermoplastic flexor 201 of the present disclosure isolated outside the chair shell 102/104. The upper extension 203, waist 205, and lower extension 207 are visible. A transverse gap 215 and bridge 213 are visible between the 205 waist and the end extension 207. The upright flange 211 of the axial channel (see 209 of FIG. 5) is visible extending from the gap 215 to the end of the lower extension 207. As will be explained in further detail, the flexor 201 interacts with an anchor connected to the frame 107 to form a plurality of fulcrums. The fulcrums may optionally be beneath the bridge 213, beneath the channel formed on the far side of the bridge (left of 213) relative to the end of the lower extension, or beneath a transition region between the lower extension and the waist.

Figure 5:
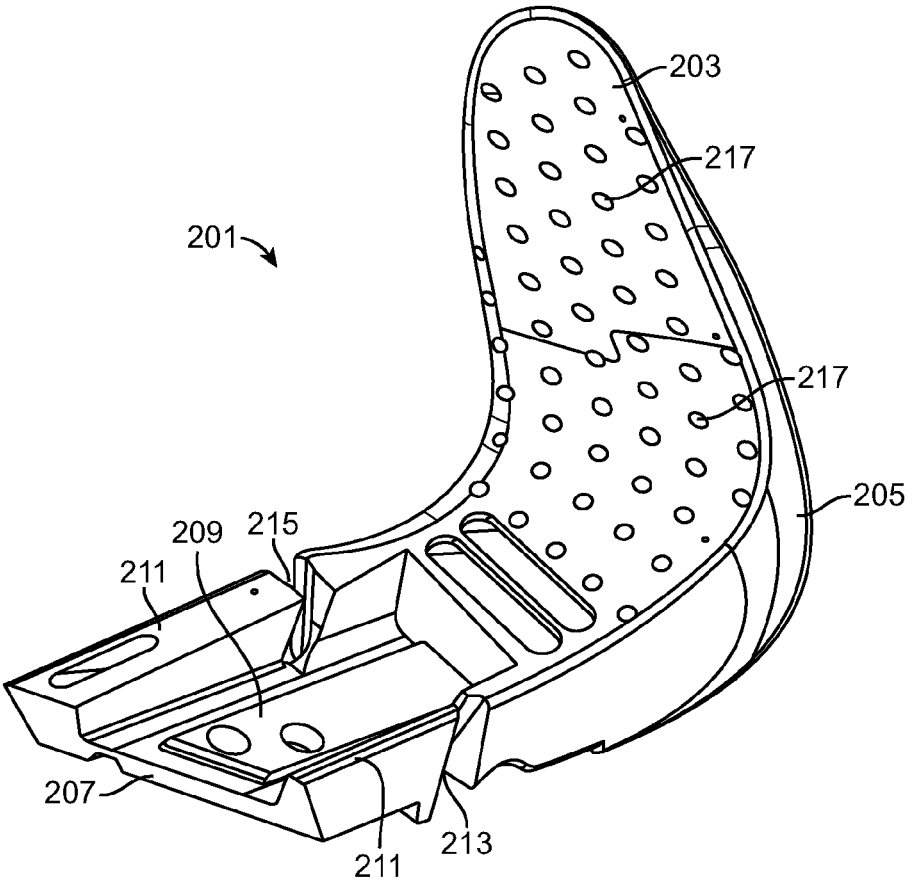
FIG. 5 is an isometric view of the thermoplastic flexor of FIG. 4. More clearly visible are the mechanical interlocks, for mechanically securing the flexor to the chair shell, as well as the axial channel extending from the waist to the end of the lower extension, as well as a pair of upright flanges on either side of the axial channel.

Turning to FIG. 5 is an isometric view of the thermoplastic flexor 201. More clearly visible are the mechanical interlocks 217, for mechanically securing the flexor 201 to the chair shell 202/204, as well as the axial channel 209 extending from the waist 205 to the end of the lower extension 207, as well as a pair of upright flanges 211 on either side of the axial channel 209. In this embodiment, the mechanical interlocks 217 are apertures which extend through the body of the upper extension 203 and waist 205. This embodiment also shows that the cross-sectional areas of the upright flanges 211 vary along their course of extension, where such variation can result in differential bending and flexing patterns.

Figure 6:
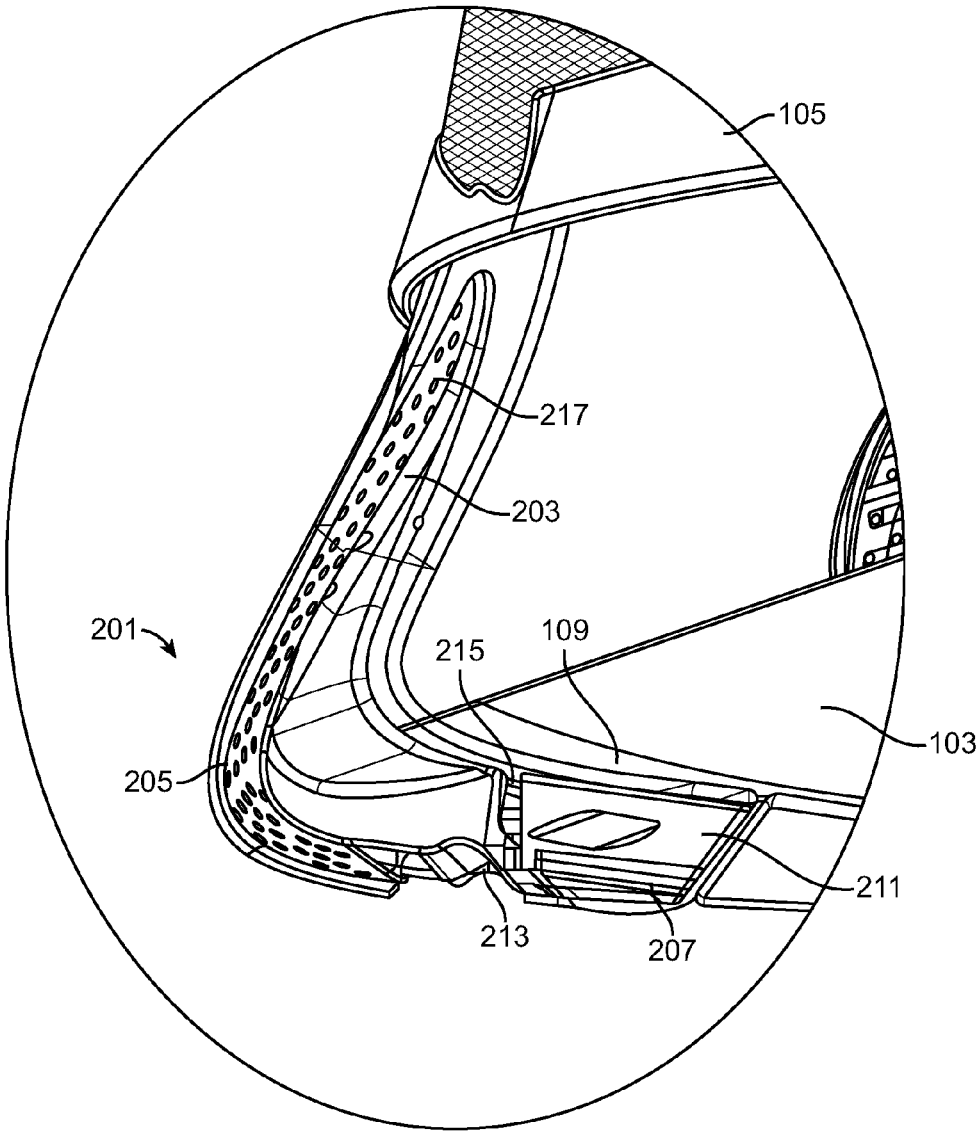
FIG. 6 is an isometric view of the thermoplastic flexor of FIG. 4 but enveloped by the chair shell.

Turning to FIG. 6 is an isometric view of the thermoplastic flexor 201 but enveloped by the chair shell 202. The flexor 201 is seen in ghost, either injection molded into the shell 102, or wherein the shell 102 has been overmolded around the flexor 201 to encase it. In this embodiment, the mechanical interlocks 217 are visible on the rear of the upper extension 203 of the flexor 201, extending throughout the waist 205. The bridge 213 and gap 215 are depicted as part of the lower extension 207 within the base 109.

Figure 7:
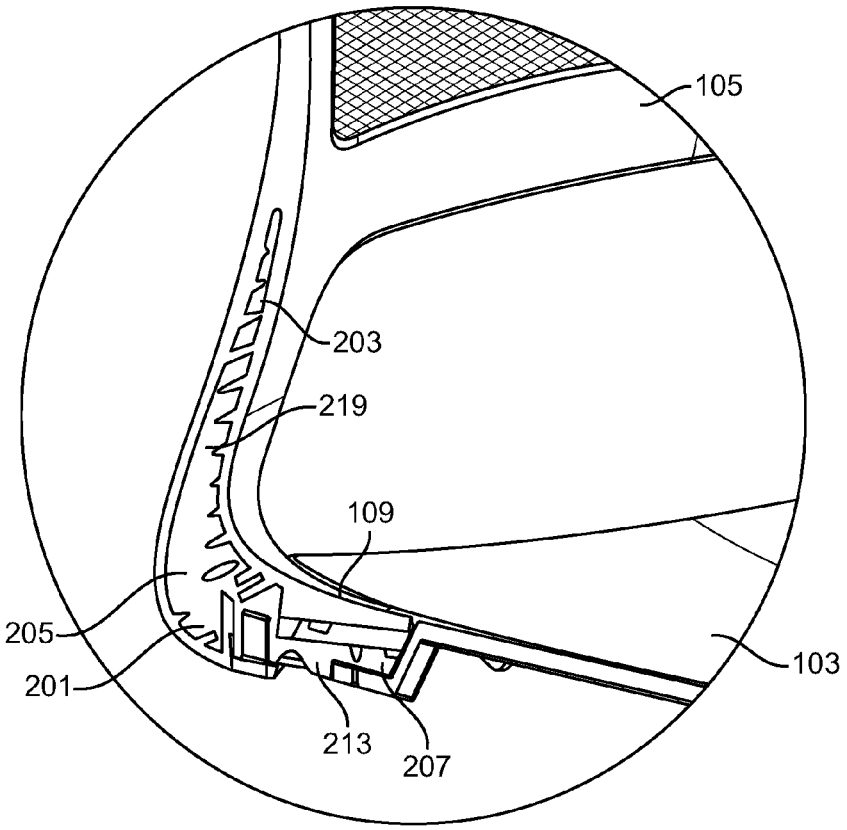
FIG. 7 is section-view of the thermoplastic flexor disclosed in FIG. 6. More clearly visible are the interlocking teeth mechanically securing the flexor to the chair shell. The interlocking teeth are formed by the mechanical interlocks in the flexor.

Turning to FIG. 7 is section-view of the thermoplastic flexor 201. More clearly visible are the mechanical interlocks 217, in this case, the apertures, when seen in section view, are effectively behaving as in some regions throughout the upper extension 207 and waist 205 as interlocking teeth, mechanically securing the flexor 201 to the chair shell 202. The upright flanges 211 which define the transverse gap 215 are not in view, because the section cuts through the middle of the axial channel 209. Thus, only visible in this depiction is the bridge 213.

Figure 8:
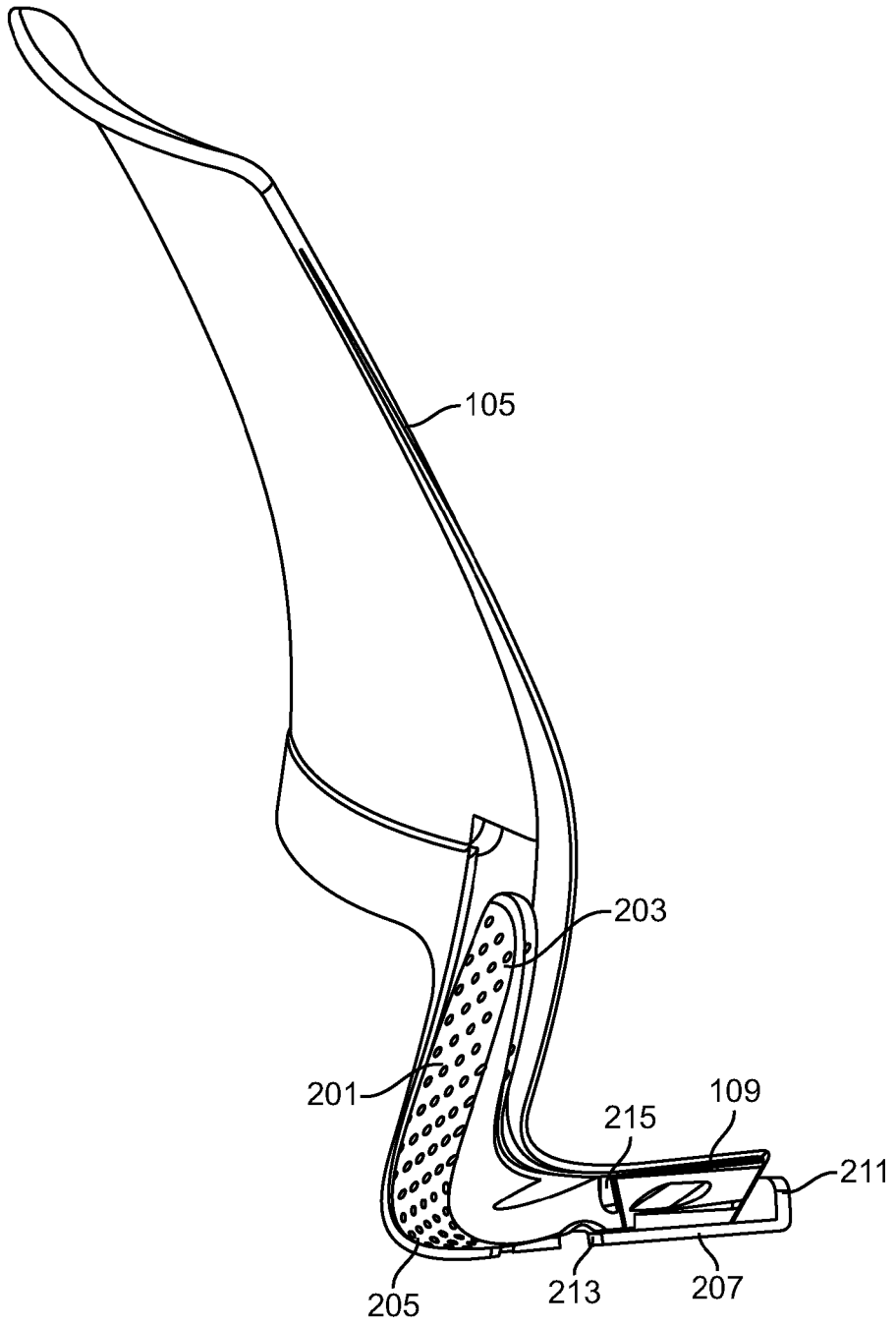
FIG. 8 is a profile view of an embodiment of the thermoplastic flexor encased in the seatback and base and mounted to the anchor of the frame. The frame is not in view.

Turning to FIG. 8 is a profile view of an embodiment of the thermoplastic flexor 201 encased in the seatback 105 and base 109 and mounted to the anchor of the frame 107. The frame 107 is not in view.

Figure 9:
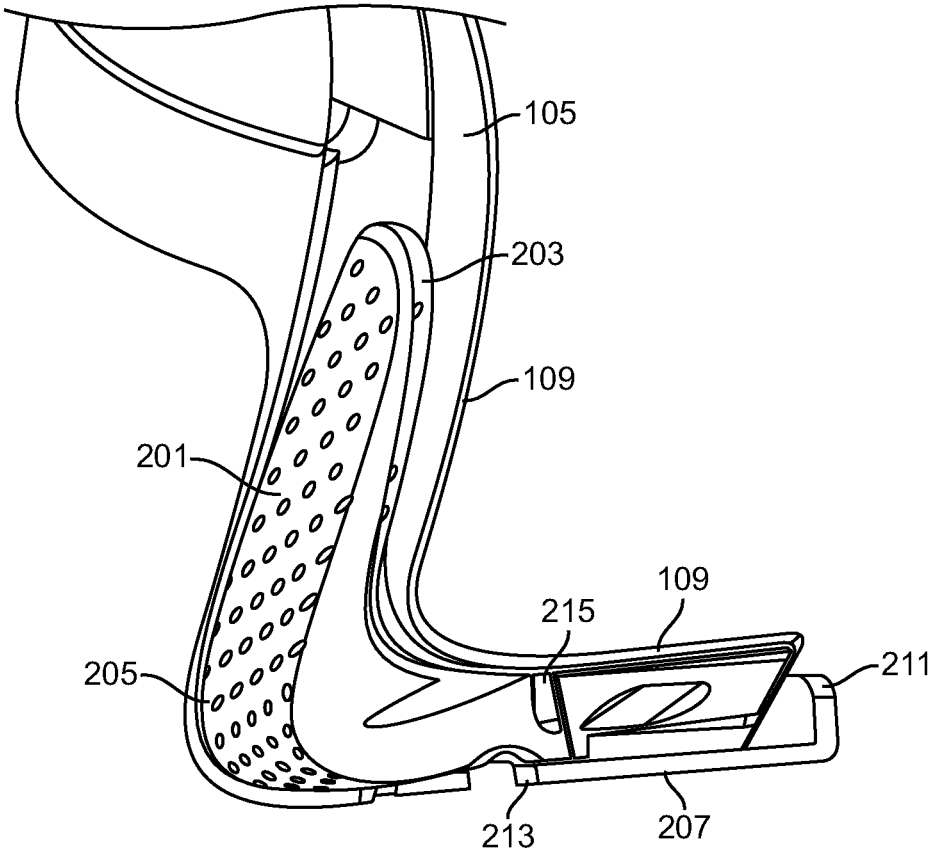
FIG. 9 is a magnified view of the encased thermoplastic flexor of FIG. 8. The anchor is more clearly visible interconnected with the lower extension

Turning to FIG. 9 is a magnified view of the encased thermoplastic flexor 201 of FIG. 8. The anchor 213 is more clearly visible interconnected with the lower extension 207.

Figure 10:
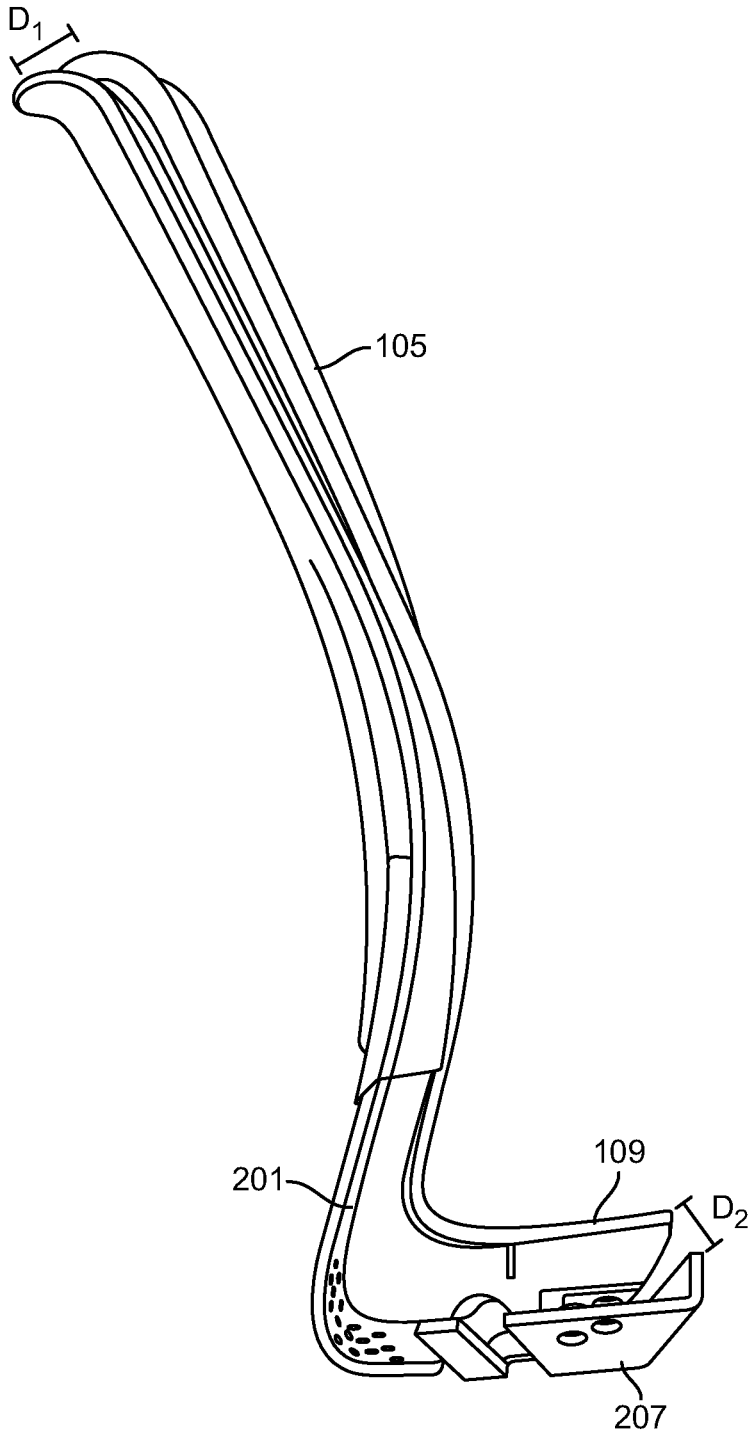
FIG. 10 is a profile view of an embodiment of the thermoplastic flexor encased in the seatback and base and mounted to the anchor of the frame to show deflection in the seatback and deflection at the fulcrums near the base. The frame is not in view.

Turning to FIG. 10 is a profile view of an embodiment of the thermoplastic flexor 201 encased in the seatback 105 and base 109 and mounted to the anchor of the frame 107. This embodiment depicts the seatback 105 when under horizontal force, causing horizontal deflection D1 in the seatback and vertical deflection D2 near the fulcrums at the base. This embodiment discloses how flexor 201 defines, resists, and determines deflection within throughout the seatback by simultaneously defining deflection in the base 109. Here the base 109 has deflected relative to the anchor and the flexor 201 is imparting a resistance throughout the base 109. The frame 107 is not in view.

Figure 11:
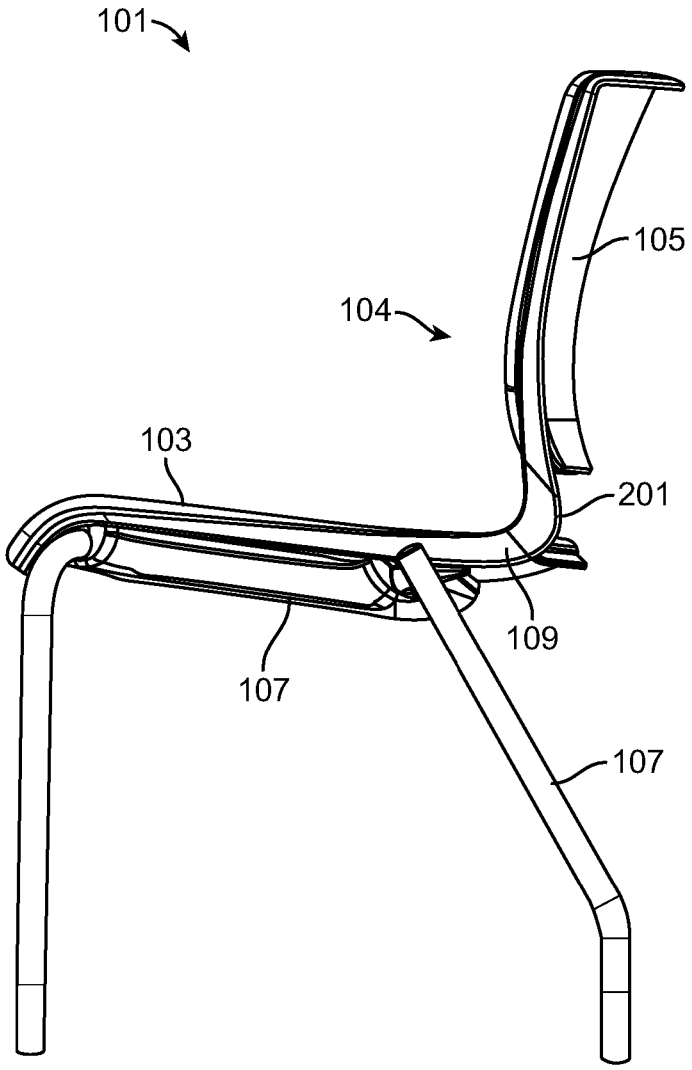
FIG. 11 is a profile view of the seating structure of the current disclosure. The seat, seatback, and base have a continuous semi-annular flange that extends to cover the thermoplastic flexor.

Turning to FIG. 11 is a profile view of the seating structure 101 of the current disclosure. In this embodiment, the seat 103, seatback 105 and base 109 comprise a unibody shell 104. The seat 103, seatback 105, and base 109 further have a continuous semi-annular flange that extends to partially cover the thermoplastic flexor 201. The unibody shell and flexor 201 are secured to the frame 107, which in this case has four legs, through an anchor.

Figure 12:
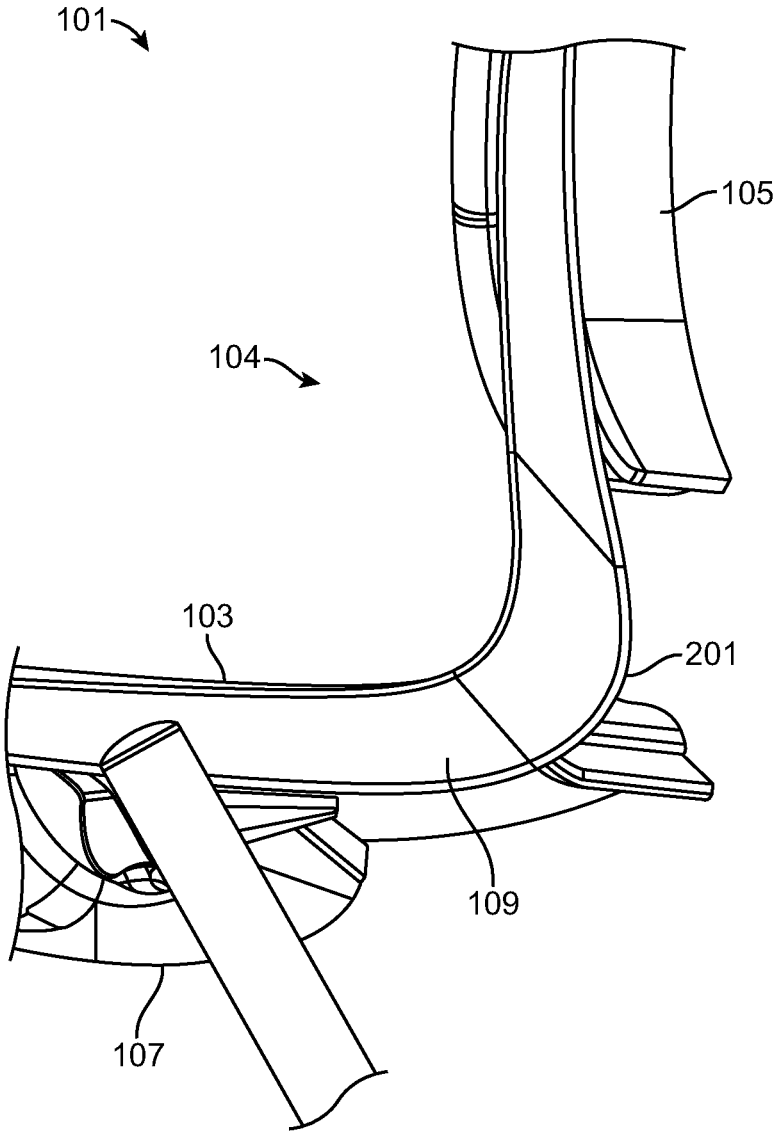
FIG. 12 is a magnified view of FIG. 11, focusing particularly on the bend in the base portion connecting the seat and seatback portions of the seating structure. The continuous semi-annular flange covering the thermoplastic flexor is more clearly visible.

Turning to FIG. 12 is a magnified view of FIG. 11, focusing particularly on the bend in the base portion 109 connecting the seat 103 and seatback 105 portions of the seating structure 101 employing a unibody shell 102. The continuous semi-annular flange partially covering the thermoplastic flexor 201 is more clearly visible.

Figure 13:
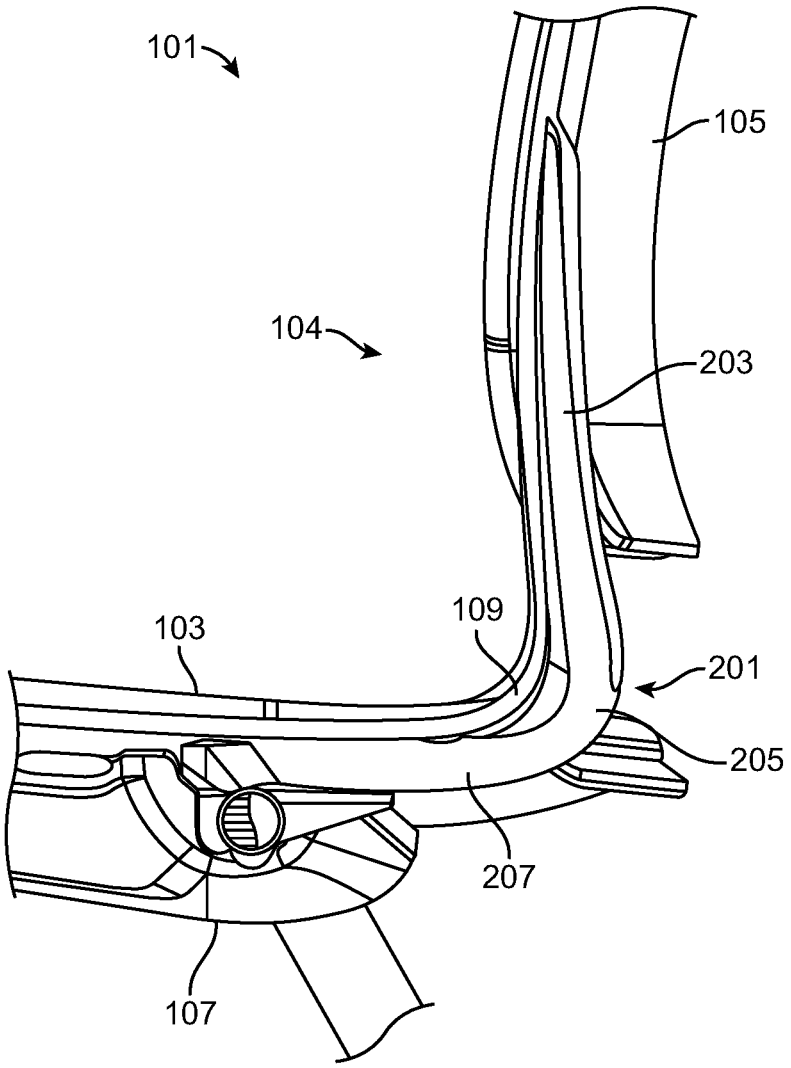
FIG. 13 is a section view of FIG. 12. Exposed is the thermoplastic flexor nested and mechanically secured to the seat, seatback, and base portions of the chair shell. The thermoplastic flexor is further connected to the anchor of the frame.

Turning to FIG. 13, is a section view of FIG. 12. Exposed is the thermoplastic flexor 201 nested and mechanically secured to the rear of the seat 103, seatback 105, and base portions 109 of a unibody chair shell 104. The thermoplastic flexor 201 is further connected to the frame 107 through an anchor.

Figure 14:
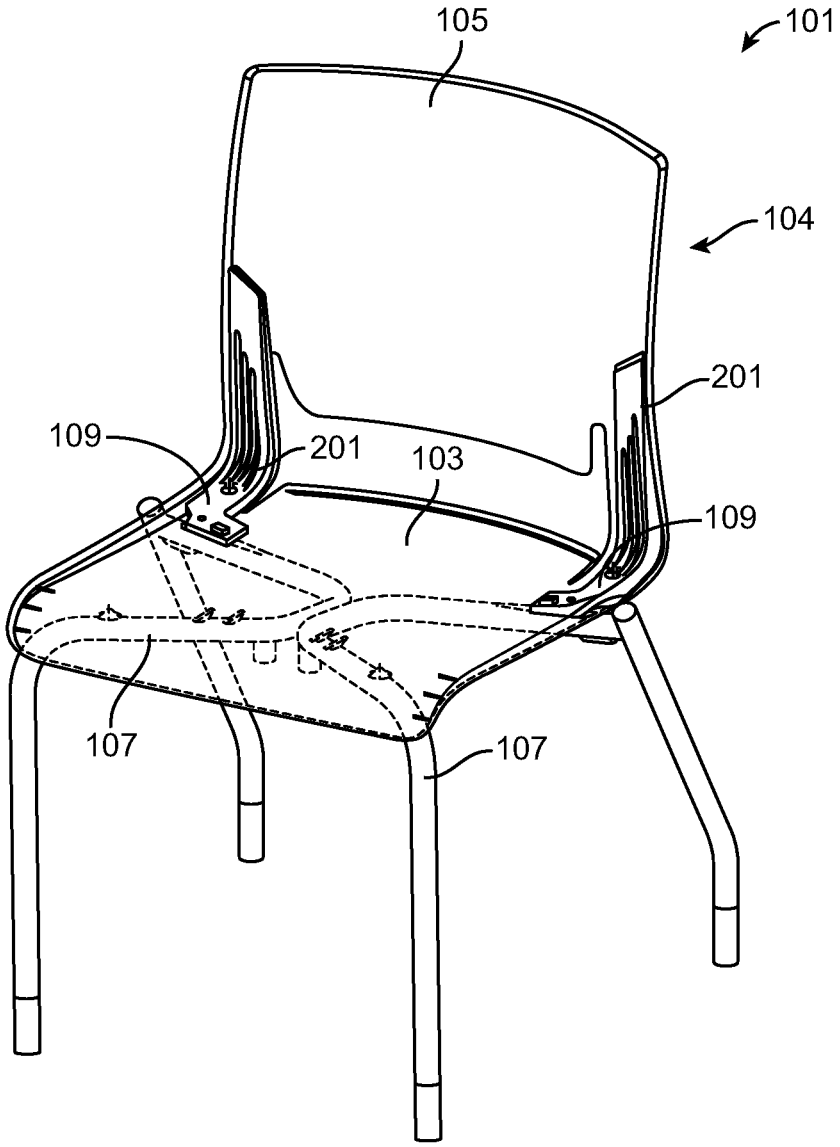
FIG. 14 is a front isometric view of an embodiment of the seating structure disclosed herein. The unibody chair shell is seen in ghost, and the chair frame, which has four legs, is connected to the underside of the seat portion. A thermoplastic flexor is seen on each side of the chair, extending from the seatback portion through the base portion to the seat portion and connected to the anchor at the frame.

Turning to FIG. 14 is a front isometric view of an embodiment of the seating structure 101 disclosed herein. The unibody chair shell 104 is seen in ghost, and the chair frame 107, which has four legs, is connected to the underside of the seat portion 103. A thermoplastic flexor 201 is seen on each side of the chair, extending from the seatback portion 105 through the base portion 109 to the seat portion 103 and connected to the anchor at the frame 107. In this embodiment, the flexor 201 is separately manufactured and affixed to the rear or the shell 104 through mechanical attachment means.

Figure 15:
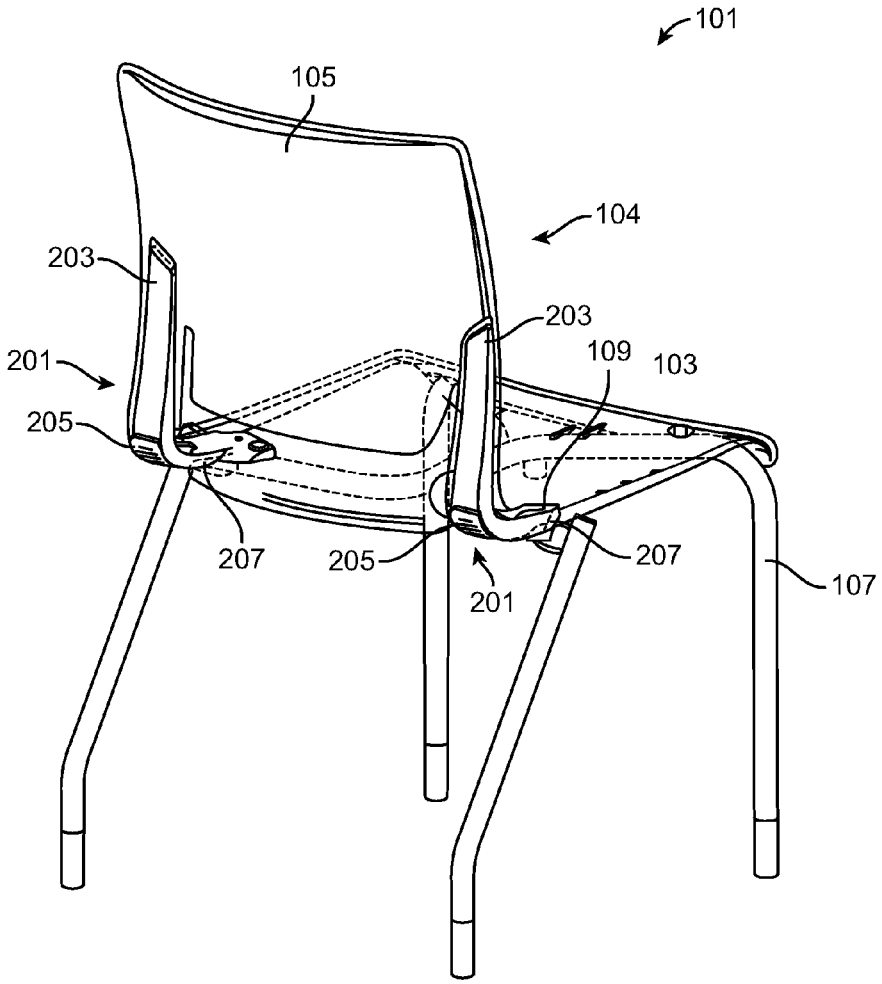
FIG. 15 is a rear isometric view of an embodiment of the seating structure disclosed herein. The unibody chair shell is seen in ghost, and the chair frame, which has four legs, is connected to the underside of the seat portion. A thermoplastic flexor is seen on each side of the chair, extending from the seatback portion through the base portion to the seat portion and connected to the anchor at the frame.

Turning to FIG. 15 is a rear isometric view of an embodiment of the seating structure 101 disclosed herein. The unibody chair shell 104 is seen in ghost, and the chair frame 107, which has four legs, is connected to the underside of the seat portion 103. A thermoplastic flexor 201 is seen on each side of the chair, extending from the seatback portion 105 through the base portion 109 to the seat portion 103 and connected to the anchor at the frame 107. In this embodiment, the flexor 201 is separately manufactured and affixed to the rear or the shell 104 through mechanical attachment means. This configuration further illustrates how the flexors 201, are only partially disposed within the base 109.

Figure 16:
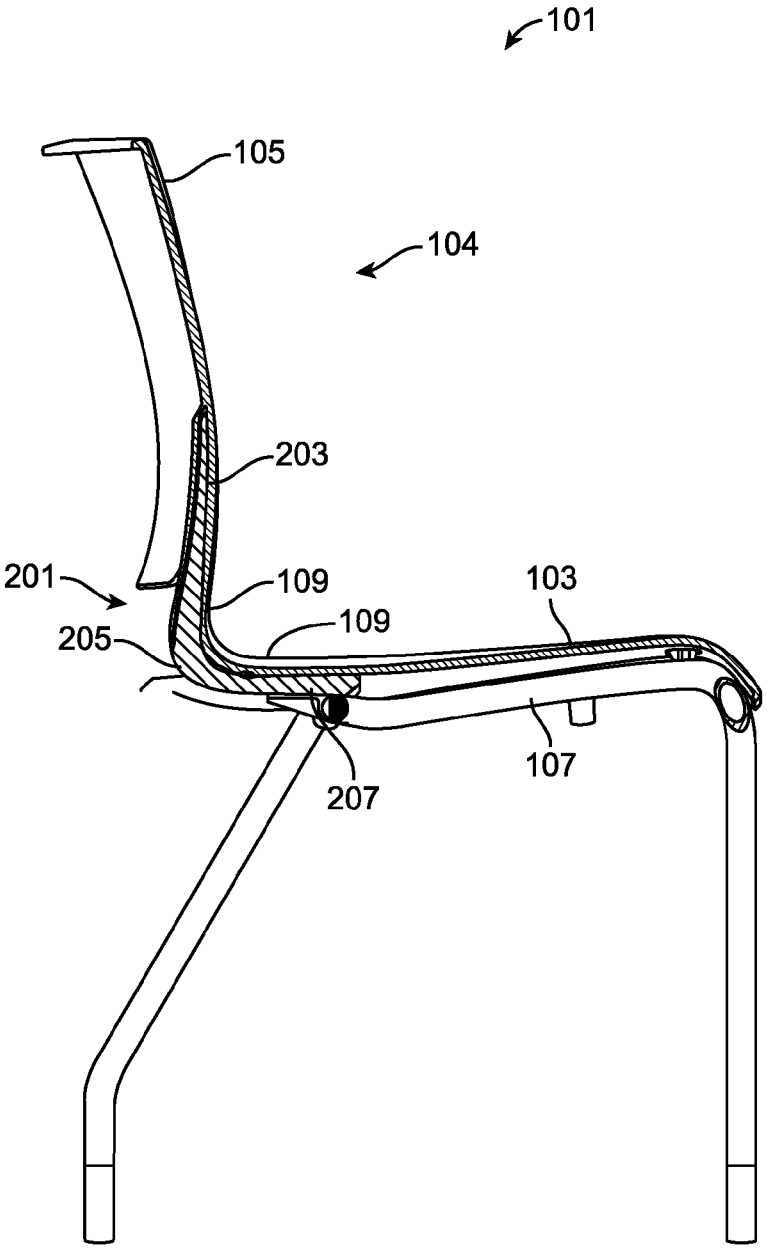
FIG. 16 is a sectional profile view of an embodiment of the disclosed seating structure. The section has been cut through the thermoplastic flexor to expose its mechanical connection and nested relationship to the rear of the seatback portion and the base portion, extending to the underside of the seat portion and connected to an anchor at the frame

Turning to FIG. 16 is a sectional profile view of an embodiment of the disclosed seating structure 101 employing a unibody shell 104. The section has been cut through the base 109 and thermoplastic flexor 201 to expose its mechanical connection and nested relationship to the rear of the seatback portion 105 and the base portion 109, extending to the underside of the seat portion 103 and connected to the frame 107 through an anchor.

Figure 17:
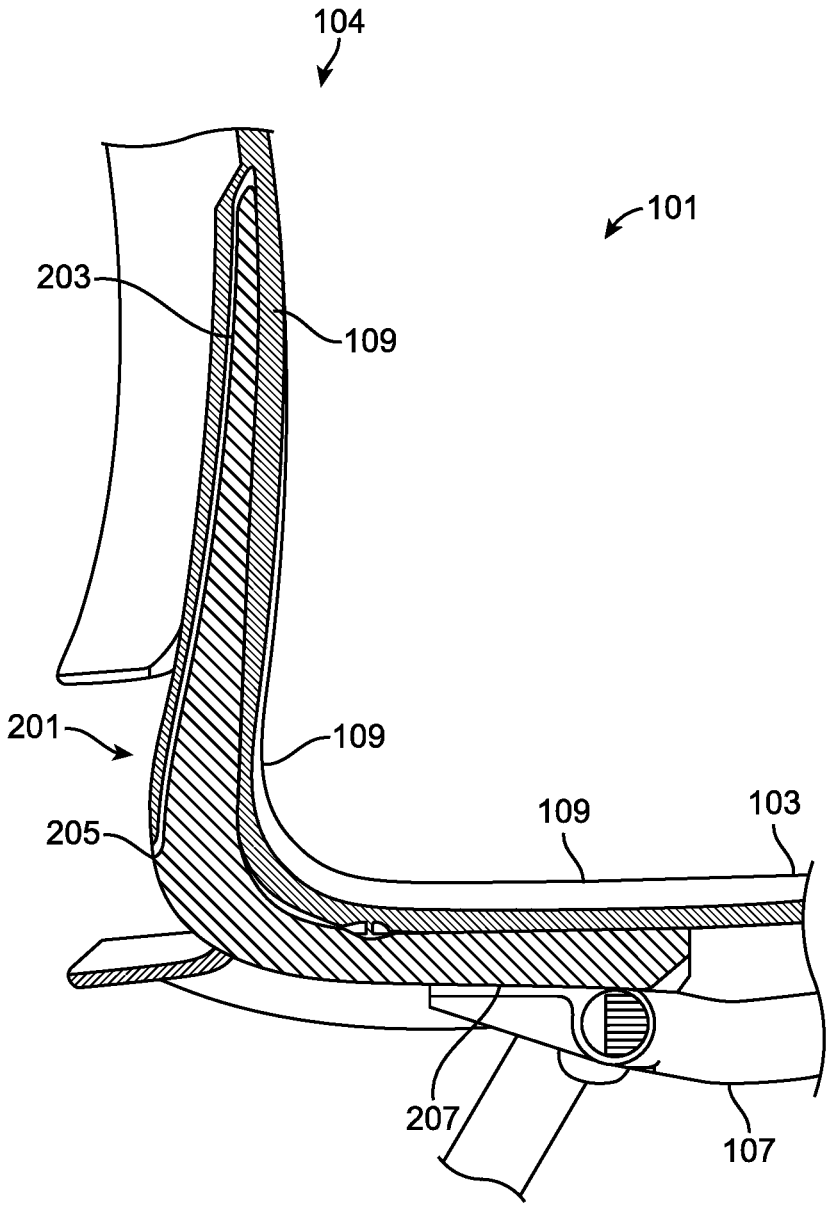
FIG. 17 is a magnified view of FIG. 16, focusing particularly on the bend in the base portion. The section has been cut through the thermoplastic flexor to expose its mechanical connection and nested relationship to the rear of the seatback portion and the base portion, extending to the underside of the seat portion.

Turning to FIG. 17 is a magnified view of FIG. 16, focusing particularly on the bend in the base portion 109. The section has been cut through the thermoplastic flexor 201 to expose its mechanical connection and nested relationship to the rear of the seatback portion 105 and the base portion 109, extending to the underside of the seat portion 103 of the unibody shell 104.

Figure 18:
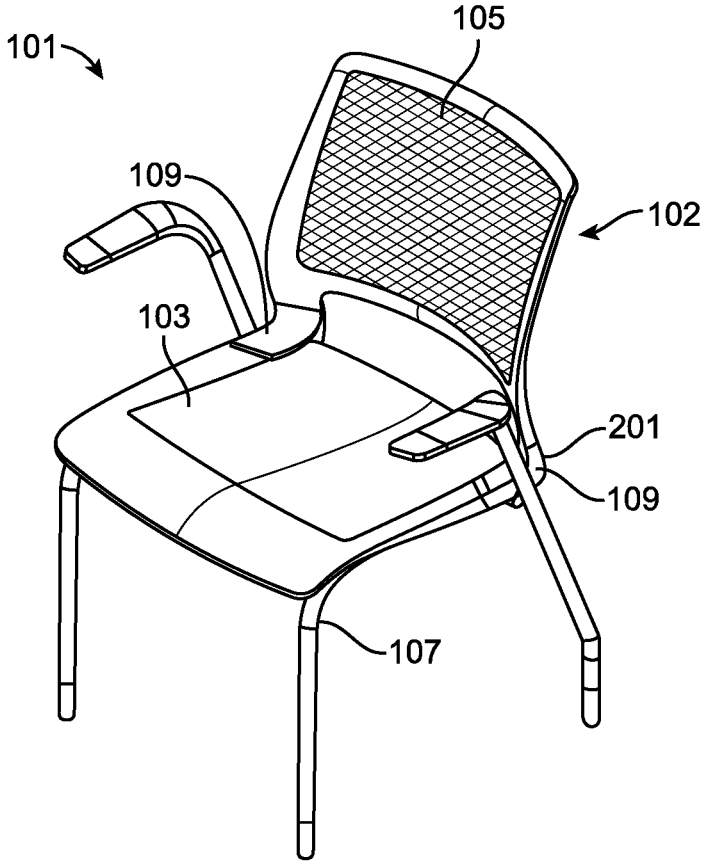
FIG. 18 is an isometric view of an embodiment of the seating structure disclosed, including armrests extending from the frame for supporting a user's arms. The thermoplastic flexor is not in view, as it is obscured by the chair shell.

Turning to FIG. 18 is an isometric view of an embodiment of the seating structure 101 disclosed, including armrests extending from the frame 107 for supporting a user's arms. The thermoplastic flexor 201 is not in view, as it is obscured by the two-piece chair shell 102.

Figure 19:
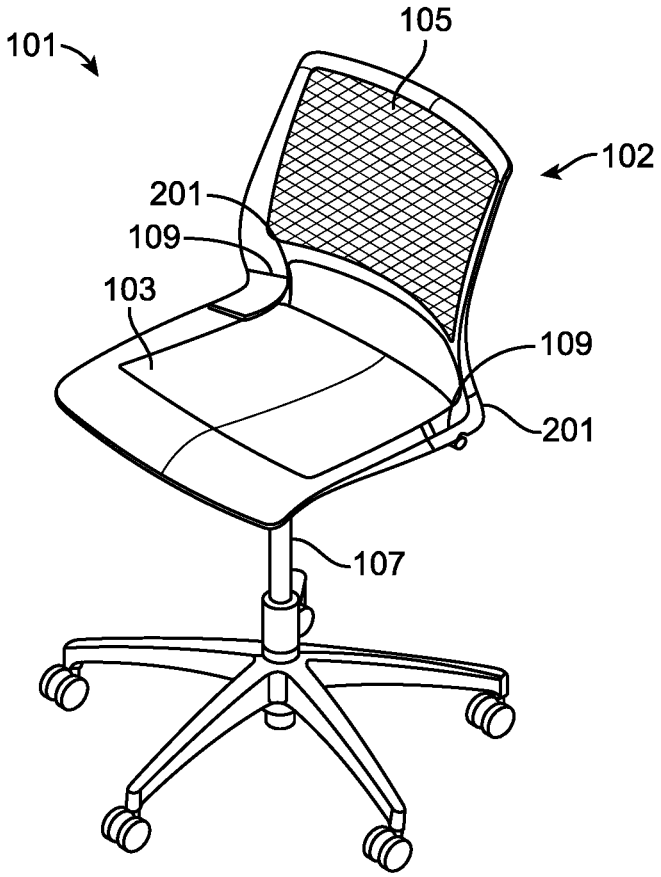
FIG. 19 is an isometric view of an embodiment of an alternative frame assembly of the seating structure disclosed, here including a lift comprising a pneumatic cylinder on wheels. The thermoplastic flexor is not in view, as it is obscured by the chair shell.

Turning to FIG. 19 is an isometric view of an embodiment of an alternative frame 107 assembly of the seating structure 101 disclosed, here including a lift comprising a pneumatic cylinder on wheels. The thermoplastic flexor 201 is not in view, as it is obscured by the two-piece chair shell 102.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Furthermore, to the extent that the term "having," "includes," or "wherein" is used in either the detailed description or the claims, such term is intended to be inclusive in a manner similar to the term "comprising" as "comprising" is interpreted when employed as a transitional word in a claim.

What is claimed is:

1. A seating structure comprising:

a. a seat portion for supporting a user, b. a seatback portion for supporting a user, c. a frame for supporting the seat portion and the seatback portion, d. a base portion extending from the seatback portion, e. a thermoplastic flexor affixed to the seatback and base portions of the seating structure, and wherein the thermoplastic flexor defines and limits a deflection and a rebound of the seatback portion relative to the base portion, wherein the thermoplastic flexor has an upper extension and a lower extension, and wherein the lower extension has a top gap stretching thereacross, and wherein a horizontal rearward force applied to the upper extension of the thermoplastic flexor spreads open the gap thereby causing the lower extension to bottom out on the frame, and f. an anchor securing the seatback portion, base portion, and thermoplastic flexor to the frame.

2. The seating structure of claim 1, wherein the thermoplastic flexor is comprised of a material having an ultimate tensile strength ranging from 5-115 MPa.

3. The seating structure of claim 1, wherein the thermoplastic flexor is comprised of a material having, an elastic modulus characteristic ranging from 587-20700 MPa.

4. The seating structure of claim 1, wherein the thermoplastic flexor is comprised of a material having a creep modulus ranging from 1800-2500 MPa when a stress is applied for one hour.

5. The seating structure of claim 1, wherein the thermoplastic flexor is comprised of a material having a yield strain of greater than 5%.

6. The seating structure of claim 1, wherein the thermoplastic flexor is a curvilinear elbow.

7. The seating structure of claim 1, wherein the thermoplastic flexor further comprises a bridge connecting two sides of the lower extension separated by the gap.

8. The seating structure of claim 7, wherein the thermoplastic flexor further comprises a first fulcrum formed at a first interface of the lower extension and the anchor, and a second fulcrum formed at a second interface of the lower extension and the anchor.

9. The seating structure of claim 8, wherein the first fulcrum is beneath the bridge.

10. The seating structure of claim 9, wherein the second fulcrum is below a transition region between the lower extension and the waist.

11. The seating structure of claim 8, wherein the thermoplastic flexor bends around the first fulcrum before the thermoplastic flexor bends around the second fulcrum.

12. The seating structure of claim 7, wherein a bending moment is applied on the bridge when a horizontal force is exerted on the seatback.

13. The seating structure of claim 7, wherein the thermoplastic flexor further comprises a fulcrum formed at an interface of the lower extension and the anchor.

14. The seating structure of claim 7, wherein the thermoplastic flexor further comprises a plurality of fulcrums formed at a plurality of interfaces along the lower extension and the anchor.

15. The seating structure of claim 1, wherein the seatback portion, base portion, and seat portion comprise a unibody thermoplastic shell.

16. The seating structure of claim 1, wherein the seatback portion and base portion are together connected to the frame independently from the seat portion.

17. The seating structure of claim 1, wherein the seatback and base portions are overmolded relative to the thermoplastic flexor.

* * * * *